US006150989A

United States Patent [19]

Aubry

[11] Patent Number: 6,150,989

[45] Date of Patent: Nov. 21, 2000

[54] CAVITY-BACKED SLOT ANTENNA RESONATING AT TWO DIFFERENT FREQUENCIES

[75] Inventor: Yvon C. Aubry, Kirkland, Canada

[73] Assignee: Sky Eye Railway Services International Inc., St. Michael, Barbados

[21] Appl. No.: 09/348,681

[22] Filed: Jul. 6, 1999

[51] Int. Cl.[7] ..... H01Q 13/10

[52] U.S. Cl. ..... 343/767; 343/770; 343/771

[58] Field of Search ..... 343/767, 770, 343/771, 772

[56] References Cited

U.S. PATENT DOCUMENTS

| | | | |
|---|---|---|---|
| 4,229,745 | 10/1980 | Kruger | 343/771 |
| 4,247,858 | 1/1981 | Eichweber | 343/771 |
| 4,839,663 | 6/1989 | Kurtz | 343/771 |
| 5,831,583 | 11/1998 | Lagerstedt et al. | 343/771 |
| 5,870,061 | 2/1999 | Casciola et al. | 343/771 |
| 5,977,925 | 11/1999 | Hamnen et al. | 343/771 |

*Primary Examiner*—Tan Ho

*Attorney, Agent, or Firm*—Oblon, Spivak, McClelland, Maier & Neustadt, P.C.

[57] ABSTRACT

A cavity-backed slot antenna constituted by a housing constructed of conductive material. The housing forms a cavity. An elongated primary slot of a given length is formed in one of the walls of the housing. A secondary slot of a given length is formed in an adjacent wall. Diodes are secured across the primary slot at a pre-determined location. An r.f. transmission line is electrically coupled to the conductive sheet across side edges of said primary slot for transmitting and receiving r.f. signals.

11 Claims, 3 Drawing Sheets

CAVITY-BACKED SLOT ANTENNA RESONATING AT TWO DIFFERENT FREQUENCIES

BACKGROUND OF THE INVENTION

1. Field of the Invention

The present invention generally relates to antenna structures and, more particularly, is concerned with a slot antenna formed in a side wall of a metal housing and is designed for attaining minimum slot length with the use of a secondary slot and attaining resonance at two frequencies with the use of diodes connected across the slot at a pre-determined position.

2. Description of the Prior Art

Cavity-backed slot antennas are well known in the prior art. This type of antenna relies on the use of a slot in a metallic plane to radiate and capture electromagnetic waves. The classic description of a slot antenna is a narrow slot, equal in length to a half wavelength, cut into an infinite plane. In practice, the plane is not infinite, but experience shows that if the metal sheet boundaries are at least a quarter wavelength from the slot, the slot will behave nearly as if the metal plane dimensions were very large, and the slot length will be close to a half wavelength in free space. However, if the width and depth (or the radius, in the case of a cylindrical box) are much smaller than a quarter wavelength, it is found that it is not possible to obtain a resonant slot with a box length which is close to the free-space half wavelength. The box must be much longer. Traditionally, cavity-backed slot antennas are composed of a metal surface backed by an energized resonant cavity and having a slot through which energy is radiated directionally. Representatives of the prior art are the cavity-backed slot antennas disclosed in U.S. Pat. Nos. Mussler (U.S. Pat. No. 4,733,245), Mori et al. (U.S. Pat. No. 4,935,745), Lee (U.S. Pat. No. 4,975,711), Woloszczuk (U.S. Pat. No. 4,983,986), Stang (U.S. Pat. No. 3,725,941), Koyama et al (U.S. Pat. No. 5,757,326), Monser (U.S. Pat. No. 4,132,995), Luedtke et al (U.S. Pat. No. 4,229,744) and Boubouleix (U.S. Pat. No. 4,491,843).

Various approaches have been proposed in certain of the above referred to patents to limit the physical size of the cavity-backed slot antenna and fine tune to the right frequencies. For instance, in Mussler (U.S. Pat. No. 4,733,245), size reduction of the slot antenna cavity is achieved primarily through use of a high dielectric constant layer placed at the radiating portion of the antenna. Also, Mussler suggests that small value capacitors be employed to permit "fine tuning" to the frequency wanted. In Lee (U.S. Pat. No. 4,975,711), two slot antennas are used, one for vertical-polarized-wave and another for slant vertical-polarized or horizontal-polarized waves. In Mori, et al. (U.S. Pat. No. 4,935,745), the antenna is formed by three plates arranged to have a generally U-shaped cross section. Again, a capacitor is used to adjust the operation frequency of the antenna.

The cavity-backed slot antennas of the cited prior art which are identified above as ones concerned with space reduction and fine tuning to the right frequencies would appear to operate reasonably well and generally achieve their objectives under the range of operating conditions for which they were designed. However, they do provide opportunities for further improvements to be made in terms of reduction of the complexity and constraints they introduced into their antenna designs to achieve the objective of reduced size. Consequently, a need still exists for improvements in cavity-backed slot antenna design that will make size reduction and resonance at two frequencies possible without introducing other factors that will diminish antenna performance and increase complexity and cost.

SUMMARY OF THE INVENTION

It is a feature of the present invention to provide a cavity-backed slot antenna designed to satisfy the aforementioned needs. The design permits to reduce the width and depth of the box considerably, much smaller than a quarter wavelength, while maintaining a box length that is close to one half wavelength in free space. A key element of the design is that one of the sides adjacent to the side containing the slot (U.S. Pat. No. primary), also contains a secondary slot that is almost the full length of the box.

According to a further feature, the slot design also permits to receive and transmit signals at two different frequencies. This is possible when the wavelength of the received signals is longer than the wavelength of the transmitted signals. The difference in wavelengths is put to advantage in the antenna by a device that permits to resonate the same slot at both the receiving and the transmitting frequencies, and to obtain optimum performance of the antenna for receiving as well as for transmitting. The slot length is chosen to resonate at the receiving frequency, which is the longer wavelength.

According to a still further feature of the present invention, the slot length is reduced for transmitting by short-circuiting the slot at the appropriate point to effect resonance at the transmitting frequency. The short-circuit is effected by two conductive diodes connected across the slot, in parallel, and in opposite polarity. The presence of these diodes does not affect the resonance of the slot at the receiving frequency, as they are non-conductive for the low level received signals.

According to the above features, from a broad aspect, the present invention provides a cavity-backed slot antenna that comprises a conductive housing having longitudinal slots on two adjacent walls. An elongated primary slot of a given length is formed in one of the two adjacent side walls. A secondary slot of a given length is formed in the adjacent side wall. It also comprises diodes secured across the primary slot at a pre-determined location. Finally, means for r.f. transmission are electrically coupled to the conductive sheet across the side edges of the primary slot to transmit and receive r.f. signals.

These and other advantages and attainments of the present invention will become apparent to those skilled in the art upon reading of the following detailed description when taken in conjunction with the drawings wherein e is shown and described an illustrative embodiment of the invention.

BRIEF DESCRIPTION OF THE DRAWINGS

In the course of the following detailed description, reference will be made to the attached drawings in which.

DETAILED DESCRIPTION OF THE PREFERRED EMBODIMENT

Figure 1:
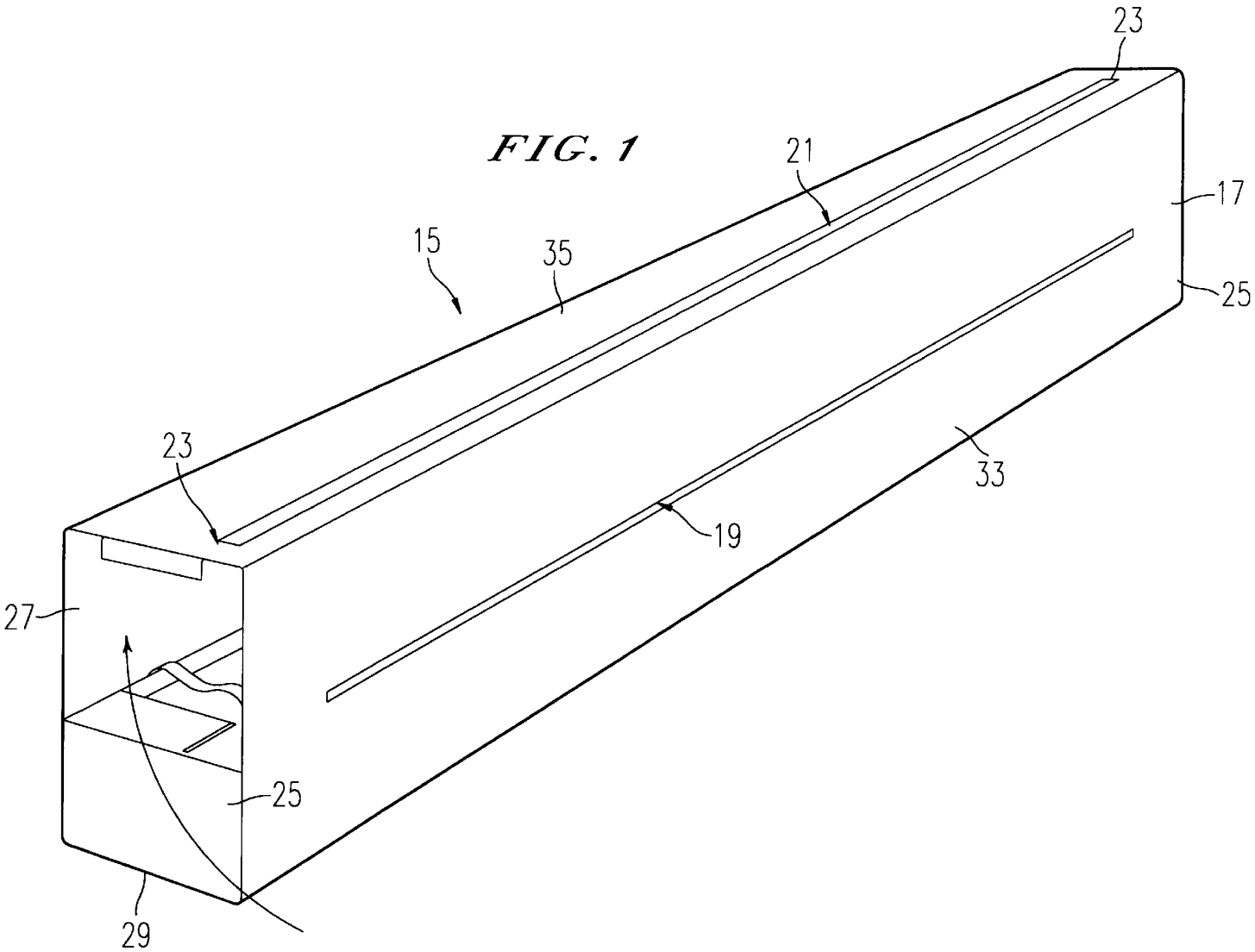
FIG. 1 is a perspective view of the box containing the slot antenna where both the secondary and the primary slots are illustrated.

Referring now to the drawings, and particularly to FIG. 1, there is shown a cavity-backed slot antenna, generally designated by the numeral 15 having the improved construction of the present invention. The antenna 15 includes an electrically conductive housing 17, a primary slot 19 for transmitting and receiving signals and a secondary slot 21. Two short-circuits 23 are provided at each end of the secondary slot 21.

More particularly, the housing 17 is fabricated of electrically conductive material such as steel or aluminum using conventional construction techniques and is in the shape of a rectangular box. The housing 17 is delimited by two end walls 25 which may be open or partly or fully closed, a bottom wall 29, a longitudinal side wall 31 behind the box, a front side wall 33 comprising the primary slot, a top wall 35 comprising the secondary slot 21 and a box interior 27. The box length can be made close to one wavelength in free space because the actual primary slot 19 has a length, which is close or shorter than one wavelength in free space, depending on the other dimensions. The secondary slot 21 is almost the full length of the box. The width of the secondary slot 21 is not critical and can be the whole width of the wall. The slots 21 must also be short-circuited at both ends, such as shown at 23, when it is wide. When it is very narrow, the capacitance coupling between its sides provides enough conduction for the antenna to operate properly. However, a solid short-circuit 23 at both ends is the preferred implementation. If there is no circuitry inside the cavity, the bottom wall could have holes to evacuate water.

Figures 2A, 2B:
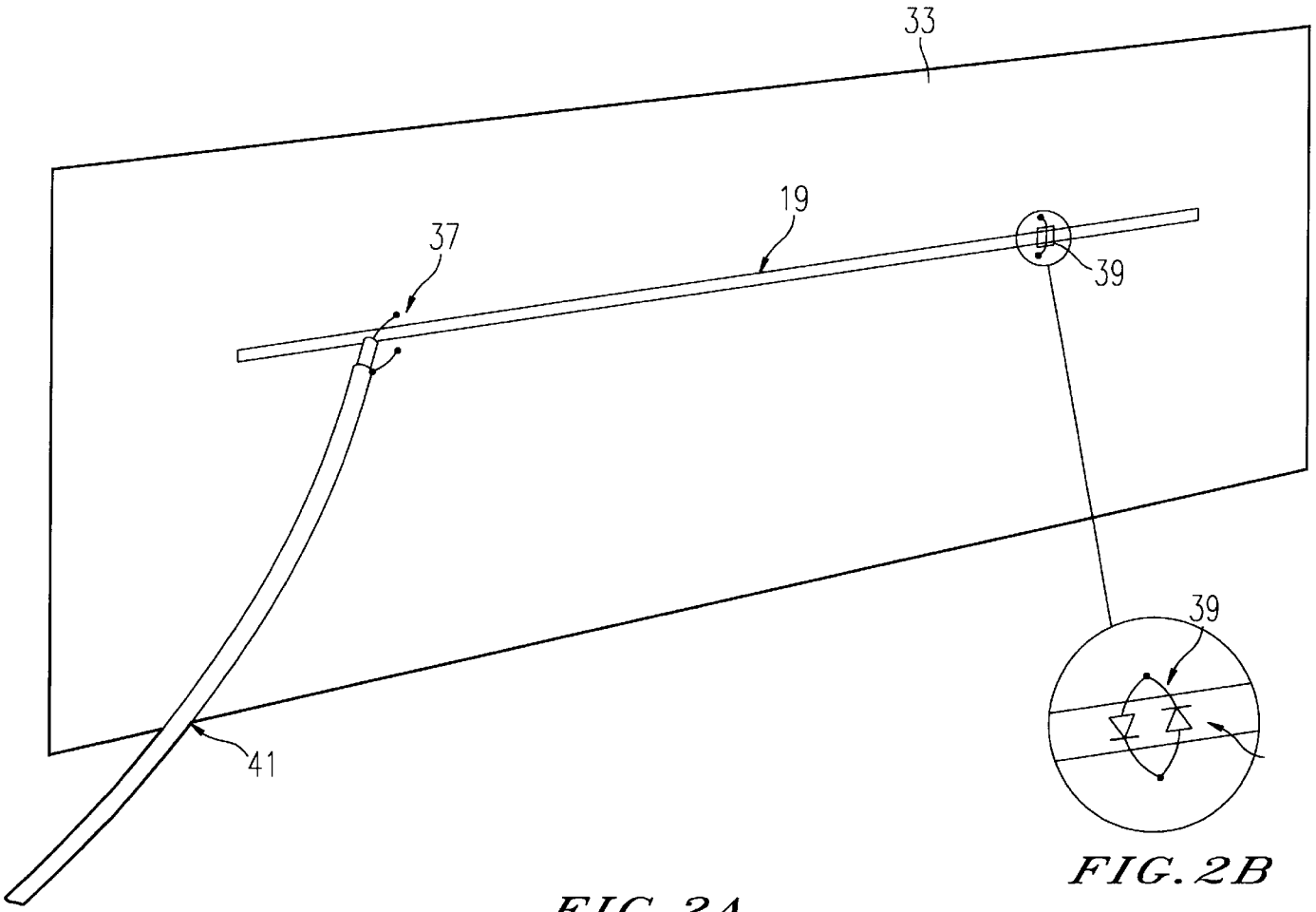
FIG. 2 is a perspective view in which the feed point of the transmission line and the diodes are illustrated with respect to the primary slot.

Illustrated in FIG. 2 is the front side wall 33 of the box when looked at from the interior 27 of the box. It is composed of the primary slot 19 having a feed point 37 where the transmission line 41 is connected. The diodes 39 are used to make the slot resonate at the chosen transmission frequencies. In the preferred embodiment, the slot antenna is used to receive signals in the band of 137 to 138 MHz and to transmit in the band 148 to 150 MHz. The wavelength of the received signals is therefore longer than the wavelength of the transmitted signals. This difference in wavelengths is put to advantage in the present antenna by a device that permits to resonate the slot at both the receiving and the transmitting frequencies, and to obtain optimum performance of the antenna for receiving as well as for transmitting. The slot length is chosen to resonate at the receiving frequency (U.S. Pat. No. longer wavelength). The primary slot 19 length is reduced for transmitting by short-circuiting the slot at the appropriate point to effect resonance at the transmitting frequency. The short-circuit is effected by two conductive diodes 39 connected across the slot, in parallel, and in opposite polarity.

Since the diodes 39 do not start conducting until the voltage across them attains 0.2 to 0.6 volts, depending on the type of diodes used, they have little effect on the received signals which are at the pvolts level, and the full length of the slot remains effective. That is, the presence of these diodes does not affect the resonance of the slot at the receiving frequency.

However, during transmission, the voltage at the location of the diodes would be much larger than 0.6 volts, were it not for the diodes, and the diodes then enter alternatively into conduction, thus creating a near shortcircuit, and effectively reducing the length of the slot to make it resonate at the transmitting frequency.

The circuitry 43 is preferably located at the bottom of the cavity. However, it can be placed anywhere in the cavity as long as there is a liberated space available in the cavity.

Figure 3:
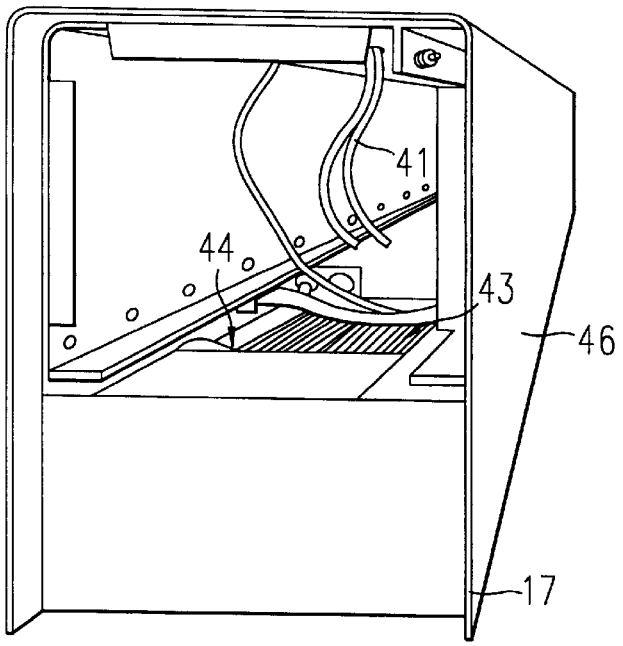
FIG. 3 is a perspective view in which the inside details of the box are shown.

FIG. 3 shows a perspective view with one end wall 25 of the box removed. What we see are the wires 41 from the solar panels (U.S. Pat. No. not shown) which is used to power the system and which can be mounted on the housing at a convenient location not to cover the slots. The panels will not affect the operation of the antenna. The electronic circuitry 43 is also secured in the lower compartment 44 of the box.

Figure 4:
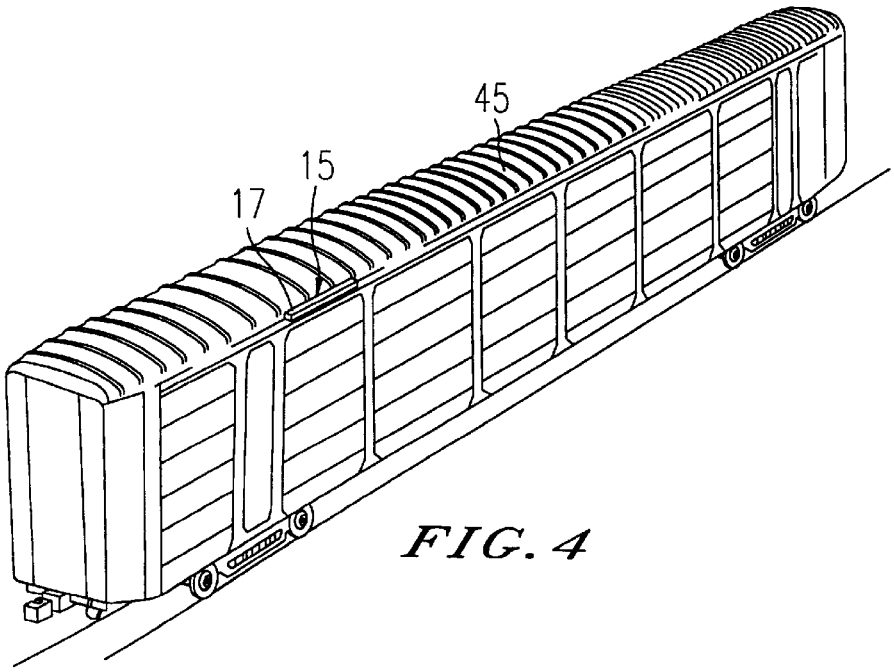
FIG. 4 is an illustration of the preferred application of the cavity-backed slot antenna mounted on a train boxcar.

As shown on FIG. 4, in a preferred application, the cavity-backed slot antenna is mounted on a freight car 45 to allow tracking of, for example, the wagon's position, temperature, etc. The circuitry 43 in the box would then monitor specific data using sensors in the car and make adjustments to the environment of the car in the case it received particular instructions via satellite communication or otherwise. This type of antenna permits transmission and reception of signals at two different frequencies, by using a small electrically conductive box and it could be used on tractor trailers and all sorts of other vehicles and transportation means.

A protective shroud 46, as shown in FIG.3, of non-conductive material could be added to the embodiment of the invention to prevent water, dirt, insects and other nuisance to obstruct the slots and disable the electronic components housed therein.

The foregoing description shows only a preferred embodiment of the present invention. Various modifications are apparent to those skilled in the art without departing from the scope of the present invention, which is only limited by the appended claims. Therefore, the embodiment shown and described is only illustrative, not restrictive.

What is claimed is:

1. A cavity-backed slot antenna comprising:

(a) a conductive housing having one slot in each of two adjacent walls, (b) one of said slots being an elongated primary slot of a given length formed in one of said two adjacent walls, (c) the other of said slots being a secondary slot of a given length formed in the other of said two adjacent walls, (d) diodes secured across said primary slot at a predetermined location; said diodes, during a transmission mode of said antenna, being conductive to short-circuit said primary slot to effectively reduce the length of said primary slot to effect resonance at the transmitting frequency while being ineffective to receiving frequencies and thereby resulting in a reduction of the length of said conductive housing, and (e) r.f. transmission means electrically coupled to said conductive housing across side edges of said primary slot for transmitting and receiving r.f. signals.

2. The slot antenna of claim 1, wherein said housing further comprises a cavity defined by a space rearward of said two adjacent walls.

3. The slot antenna of claim 2, wherein said cavity has a depth and width that are substantially less than one-quarter wavelength.

4. The slot antenna of claim 1, wherein there are two of said diodes connected across said primary slot and in opposite polarity.

5. The slot antenna of claim 1, wherein said secondary slot has a length, which is almost the full length of said housing.

6. The slot antenna of claim 1, wherein said secondary slot has a width which is very narrow.

7. The slot antenna of claim 1, wherein said secondary slot is short-circuited at both ends.

8. The slot antenna of claim 1, wherein said cavity-backed slot antenna comprises electronic components secured in a cavity inside said conductive housing.

9. The slot antenna of claim 8, wherein said electronic components are in a lower portion of said cavity.

10. The slot antenna of claim 1, wherein a protective shroud of a non-conductive material is added to the housing of said cavity-backed slot antenna.

11. The slot antenna of claim 1, wherein said secondary slot extends the full width of said other of said two adjacent walls.

* * * * *